US008936134B2

(12) United States Patent
Lipniarski

(10) Patent No.: US 8,936,134 B2
(45) Date of Patent: Jan. 20, 2015

(54) THREE/FOUR STEP LADDER WITH A CURVE ABOUT

(71) Applicant: Confer Plastics, Inc., North Tonawanda, NY (US)

(72) Inventor: David J. Lipniarski, North Tonawanda, NY (US)

(73) Assignee: Confer Plastics, Inc., North Tonawanda, NY (US)

( * ) Notice: Subject to any disclaimer, the term of this patent is extended or adjusted under 35 U.S.C. 154(b) by 0 days.

(21) Appl. No.: 13/970,152

(22) Filed: Aug. 19, 2013

(65) Prior Publication Data

US 2014/0069742 A1 Mar. 13, 2014

Related U.S. Application Data

(60) Provisional application No. 61/684,323, filed on Aug. 17, 2012.

(51) Int. Cl.

| | |
|---|---|
| ***E04F 11/02*** | (2006.01) |
| ***E04G 1/34*** | (2006.01) |
| ***E04H 4/14*** | (2006.01) |

(52) U.S. Cl.

CPC ..... *E04H 4/144* (2013.01)
USPC ..... 182/194; 182/151; 182/33; 52/182

(58) Field of Classification Search

USPC ..... 182/194, 33, 151; 52/182
See application file for complete search history.

(56) References Cited

U.S. PATENT DOCUMENTS

| | | | | |
|---|---|---|---|---|
| 3,578,110 | A * | 5/1971 | Seagraves | 182/129 |
| 5,644,873 | A * | 7/1997 | Bourgault | 52/182 |
| 8,037,649 | B2 * | 10/2011 | Jakubowski et al. | 52/182 |
| 8,181,739 | B2 * | 5/2012 | Genova | 182/33 |
| 8,499,507 | B1 * | 8/2013 | Saccoccio et al. | 52/182 |
| 2003/0121221 | A1 * | 7/2003 | Kress | 52/182 |
| 2006/0272230 | A1 * | 12/2006 | Elwood | 52/182 |
| 2014/0150358 | A1 * | 6/2014 | St-Pierre | 52/182 |

* cited by examiner

*Primary Examiner* — Alvin Chin-Shue
(74) *Attorney, Agent, or Firm* — Roach Brown McCarthy & Gruber, P.C.; Kevin D. McCarthy

(57) ABSTRACT

A three-step pool ladder having the capability to have a fourth step and/or a curve-about ladder apparatus.

2 Claims, 10 Drawing Sheets

THREE/FOUR STEP LADDER WITH A CURVE ABOUT

CLAIM OF PRIORITY

This application claims priority to U.S. provisional patent application Ser. No. 61/684,323, filed on Aug. 17, 2012.

FIELD OF THE INVENTION

The current application is directed to a plastic blow-molded step ladder.

BACKGROUND OF THE INVENTION

The present invention relates generally to molded articles which may be blow molded such as a blow-molded ladder or a blow-molded staircase for a swimming pool.

Swimming pool ladders or staircases and various other articles have been made from a plastic material by a process known as "blow-molding," as exemplified in commonly assigned U.S. Pat. No. 4,023,647 to Confer, commonly assigned U.S. Pat. No. 4,067,614 to Confer et al, and U.S. Pat. No. 4,166,833 to Schurman, all of which patents are hereby incorporated herein by reference. In the process of blow molding, a hollow thin-walled structure is formed having an exterior surface separated from an interior surface by the thin wall, and the hollow structure contains a fluid, in most cases air and/or water.

Walter, in U.S. Pat. No. 1,911,539, Doernemann, in U.S. Pat. No. 5,536,111, Troester, in U.S. Pat. No. 5,013,508, and Tokunaga, in U.S. Pat. No. 3,759,043, all disclose a three-dimensional polymeric structure having a male and a female interlocking component. Not one of these disclosures has both interlocking components on a single side of the structure. Moreover, these references disclose both interlocking components contacting the edges of the sides, which allow easier forces to separate the components. As such, none of these references discloses an apparatus that forms at least a male and a female interlocking component on a single side, and preferably not contacting an edge of the side, of the structure.

In commonly assigned U.S. Pat. No. 7,234,780; Lipniarski wrote, "A device and method for forming an indented female connector where the dimension of the indented female connector provides for removing a male molding component without damaging a set of internal ribs formed inside the female connector. A structure comprising an indented female blow-molded connector having a first wall having a top surface and a thickness, with the first wall surrounding an opening. At least one inner wall extends substantially perpendicular to the first wall and borders the opening. At least one rib is formed in the inner wall. A bottom wall is joined to the inner wall and the distance from the rib to the top surface is greater than the thickness of the first wall. The structure further comprising a male connector having a contact edge that, when positioned inside the indented female blow-molded connector, engage the at least one rib, such that the male connector and indented female blow-molded connector are releaseably joinable with one another. Structures can be made that use the indented female blow molded connectors and male connectors including braced stools having three or four legs." This connection system requires the male component be inserted immediately into a female locking area (a.k.a., an immediate locking system), which is difficult for easy and secure assembly.

Since most blow molded polymeric materials have an immediate locking system, most blow molded polymeric materials having an immediate locking system also require additional interconnection devices be used to secure the assembly. Those additional interconnection devices include and are not limited to rods, screws and other conventional interconnection devices. See U.S. Pat. No. 6,769,513.

In commonly assigned U.S. Pat. No. 8,202,018, Lipniarski wrote, that "invention is directed to a blow molded plastic object having a female interconnection system comprising a receiving area and a locking area. We are aware of one patent that discloses a similar a female interconnection system. That patent is commonly assigned U.S. Pat. No. 6,190,600; which is hereby incorporated by reference. In that patent, Lipniarski wrote, 'The present invention relates to an apparatus that forms a polymeric structure. The apparatus has a mold plate, a circular trench, a male and female interconnect, a vertical gap filler, and a cylinder. The mold plate has a predetermined geometric design. The circular trench is in the mold plate and the difference between the outer diameter and the inner diameter of the circular trench is a distance D. The male interconnect and the female interconnect are interspaced between each other. Each interconnect rotates within the circular trench and has a base and an interconnection portion. Each base has a width D and slidably mates to the mold plate. Each interconnect portion has a minimum width W which is less than D. The male interconnect portion protrudes downwards relatively from its base to a distance P, likewise the female interconnect portion protrudes upwards relatively from its base to a distance P. The vertical gap filler aligns with the circular trench and has a foundation and an extension. The extension has a width greater than W, a height greater than 2P, and protrudes upwards and downwards from its foundation. The cylinder rotates each interconnect to a predetermined position and raises the vertical gap filler so the foundation connects to the mold plate before any polymeric material is applied to the apparatus to form the polymeric structure. Once the polymeric structure is formed, the cylinder lowers the vertical gap filler until the extension is below the mold plate a distance greater than P and rotates each interconnect so the polymeric structure can be removed from the apparatus."

The claimed device in U.S. Pat. No. 6,190,600 is a mold for creating a first blow molded object that had a first male structure having a first extension and a first block and a first female structure having first receiving area and a first inhibiting area; and a second blow molded object that had a second male structure having a second extension and a second block and a second female structure having second receiving area and a second inhibiting area. Thereby the first blow molded object and the second blow molded object could have the first male structure inserted into the second receiving area and the second male structure inserted into the first receiving area. Rotating the first blow molded object in relation to the second blow molded object so the first male structure slides into the second inhibiting area and the second male structure slides into the first inhibiting area. The first and second inhibiting areas have no blow molded locking mechanism to secure the respective male structures in the inhibiting areas. Instead the inhibiting areas rely on the walls (which surround [that means a back wall] the male structure except where the male interconnect slides from the receiving area to the inhibiting area and the male extension that protrudes through an opening in the female inhibiting area) to provide a friction fit to inhibit the male structure from releasing itself from the female structure. The lack of a locking mechanism is acceptable for wave dispersion systems but not for ladders which require a more secure system. The present invention solves this problem for blow molded structures that require a secure locking mechanism.

SUMMARY OF THE INVENTION

A ladder 10 having a first flexible riser 16 and second flexible riser 16*a*, each riser having a top riser surface 162, a bottom riser surface 163, a front riser surface 164, a rear riser surface 165, a first side riser surface 166 having a first upper hour-glass protrusion 34 and a first lower hour-glass protrusion 36 and a second riser side surface 167 having a second upper hour-glass protrusion 34*a* and a second lower hour-glass protrusion 36*a;* a non-top step 15 having an upper step surface has a top riser groove 151 to receive the second riser's bottom surface, a front step surface 152, a rear step surface 153, a first side step surface 154, a second side step surface 155, a bottom step surface 61 having (a) a bottom riser groove 60 (i) to receive the first riser's top surface and (ii) extends from near the first side step surface to near the second side step surface, and (b) a first two-part aperture 77 positioned between the riser groove 60 and the first side step surface 152 and a second two-part aperture 77*a* positioned between the riser groove 60 and the second side step surface 152 wherein each two-part aperture has a receiving area 78 and a securing area 79 wherein the securing area 79 in relation to the receiving area is closer to the front step surface 152;

a right support 12 and a left support 14;

wherein each right support surface and left support has (A) an interior support surface 401 that contacts the first and second risers 16, 16*a*, (B) an exterior support surface 402, (C) a bottom support surface 403, (D) a back support surface 404, (E) a front support surface 405, (F) a step support section 40 having an essentially planar surface 70 with (i) a male step protrusion 70 that is capable of entering into the receiving area 78 and sliding into the securing area 77 and (ii) a high aperture 30 (a) positioned between the male step protrusion 70 and a back overhang area 776, and (b) having at least one side male protrusion 42, 43 capable of contacting or securing a narrow section 38 of the respective upper hour-glass protrusion 34, 34*a*, (G) the back support overhang area 776 having a downward protrusion 82 that positions itself into the top riser groove 84 when the male step protrusion 70 is positioned in the securing area 77, and (H) a low support aperture 32 (i) positioned below and a distance from the high aperture 30, (ii) having (a) a broad entry area 50 and (b) a riser secure area 52 wherein the respective lower hour-glass protrusion 36 is capable of entering into the broad entry area 50 and sliding into the riser secure area 52 when the upper hour-glass protrusion 34 is positioned in the upper aperture 30, wherein elements (A) to (H) form a hollow cavity that can be filled with air or a liquid;

wherein at least one of the right support surface 12 and left support surface 14 is capable of receiving a curve-about apparatus 200 on the exterior support surface 402, then the step support section 72 also has a curve-about receiver 74 positioned between the high aperture 30 and the back overhang area 776;

wherein the longitudinal axis 450 of both the right support surface and the left support surface extends from the back support surface to the front support surface.

The ladder as described above wherein the curve-about apparatus 200 has a curve-about first flexible riser 160 and a curve-about second flexible riser 160*a* wherein each curve-about flexible riser 160, 160*a* has a top curve-about riser surface 162*a*, a bottom curve-about riser surface 163*a*, a front curve-about riser surface 164*a*, a rear curve-about riser surface 165*a*, a first curve-about side riser surface 166*a* having a first upper hour-glass protrusion 634*a* and a first lower hour-glass protrusion 636*a* and a second curve-about riser side surface 167*a* having a middle protrusion 636 having an hour-glass shape wherein a narrow section is capable of being securely positioned in the broad entry area 50 when the curve-about apparatus 200 connects to the ladder 10;

a curve-about non-top step 515*a* having an upper curve-about step surface has, like the ladder steps 15, a top curve-about riser groove 151 to receive the curve-about second riser's bottom surface, a front curve-about step surface 152, a rear curve-about step surface 153, a first curve-about side step surface 154, a second curve-about side step surface 155, a bottom curve-about step surface 60 having (a) a bottom curve-about riser groove 60 (i) to receive the first curve-about riser's top surface and (ii) extends from near the first curve-about side step surface to near the second curve-about side step surface, and (b) a first curve-about two-part aperture 77 (i) positioned between the curve-about riser groove 60 and the first curve-about side step surface 152 and (ii) having a curve-about receiving area 78 and a curve-about securing area 79 wherein the curve-about securing area in relation to the curve-about receiving area is closer to the front curve-about step surface, and an insertion slot 740 positioned below the bottom curve-about step surface and capable of being inserted into the curve-about receiver 74 when the middle protrusion 636 is positioned in the broad entry area 50;

a curve-about support surface 820 having like the other supports 12, 14, (A) an interior curve-about support surface 40 that contacts the first curve-about riser 160, 160*a*, (B) an exterior curve-about support surface 402, (C) a bottom curve-about support surface 403, (D) a back curve-about support surface 404, (E) a front curve-about support surface 405, (F) a curve-about step support section 40 having an essentially planar surface 70 with (i) a curve-about male step protrusion 70 that is capable of entering into the curve-about receiving area 78 and sliding into the curve-about securing area 77 and (ii) a curve-about high aperture 30 (a) positioned between the curve-about male step protrusion 70 and a curve-about back overhang area 776, and (b) having at least one side curve-about male protrusion 42, 43 capable of contacting a curve-about narrow section 38 of the curve-about upper hour-glass protrusion 634, (G) the curve-about back support overhang area having a curve-about downward protrusion that positions itself into the curve-about top riser groove when the curve-about male step protrusion is positioned in the curve-about securing area, and (H) a curve-about low support aperture (i) positioned below and a distance from the curve-about high aperture, (ii) having (a) a curve-about broad entry area and (b) a curve-about riser secure area wherein the respective lower hour-glass protrusion is capable of entering into the broad entry area and sliding into the curve-about riser secure area when the curve-about upper hour-glass protrusion is positioned in the curve-about upper aperture, wherein elements (A) to (H) form a hollow cavity that can be filled with air or a liquid;

wherein the curve-about support surface is at least transverse to the longitudinal axis.

The ladder as described above further comprising a top step having a top upper step surface, a top front step surface, a top rear step surface, a top first side step surface, a top second side step surface, a top bottom step surface having (a) a bottom riser groove (i) to receive the second riser's top surface and (ii) extends from near the top first side step surface to near the top second side step surface, and (b) a top first front two-part aperture positioned between the top riser groove and the top first side step surface, a top second front two-part aperture positioned between the top riser groove and the top second side step surface, a top first back two-part aperture positioned behind and a distance from the top first front two-part aperture and a top second back two-part aperture positioned behind and a distance from the top second front two-part aperture wherein each two-part aperture has a top receiving area and a top securing area wherein the top securing area in relation to the top receiving area is closer to the top front step surface;

the right support and the left support each has a top step support section having (i) a top front male step protrusion and a top back male step protrusion, wherein each top male step protrusion is capable of entering into the respective top front and top back receiving areas and sliding into the respective securing area and (ii) a high aperture (a) positioned between the male step protrusion and the back support surface, and (b) having at least one side male protrusion capable of contacting a narrow section of the second upper hour-glass protrusion.

The ladder as described above wherein each top step support surface has a fourth step extension aperture capable of receiving a fourth step support's extension wherein the fourth step support has a fourth top step support section having (i) a fourth top front male step protrusion and a fourth top back male step protrusion, wherein each fourth top male step protrusion is capable of entering into a fourth step's top front and top back receiving areas and sliding into the fourth step's top securing area and (ii) a fourth step high aperture (a) positioned between the male step protrusion and the back support surface, and (b) having at least one side male protrusion capable of contacting a narrow section of a fourth step riser's upper hour-glass protrusion.

The ladder as described above wherein the right and left supports each have a rail opening that receives a rail's bottom hour-glass configuration.

DESCRIPTION OF THE INVENTION

Figure 1:
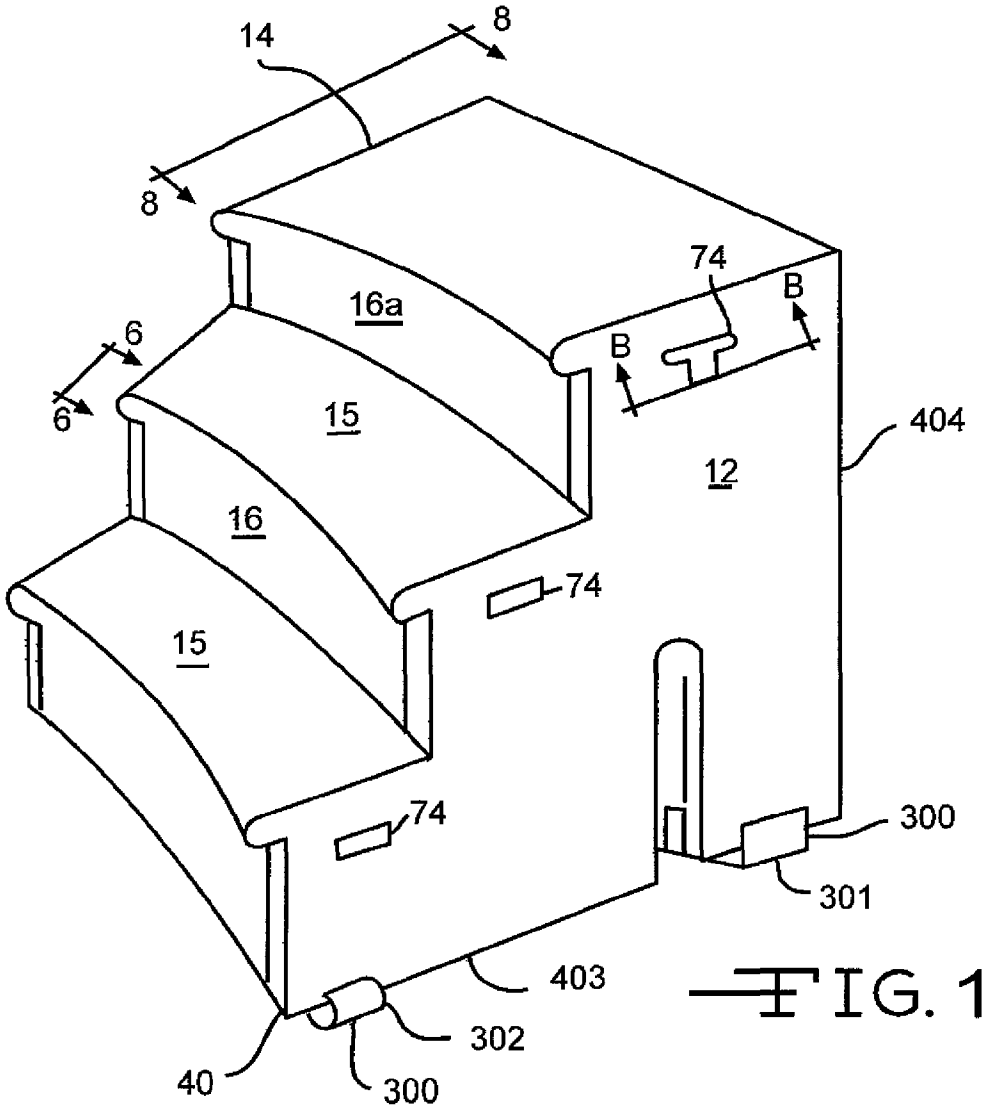
FIG. 1 is an isometric view of a ladder.
Figure 2A:
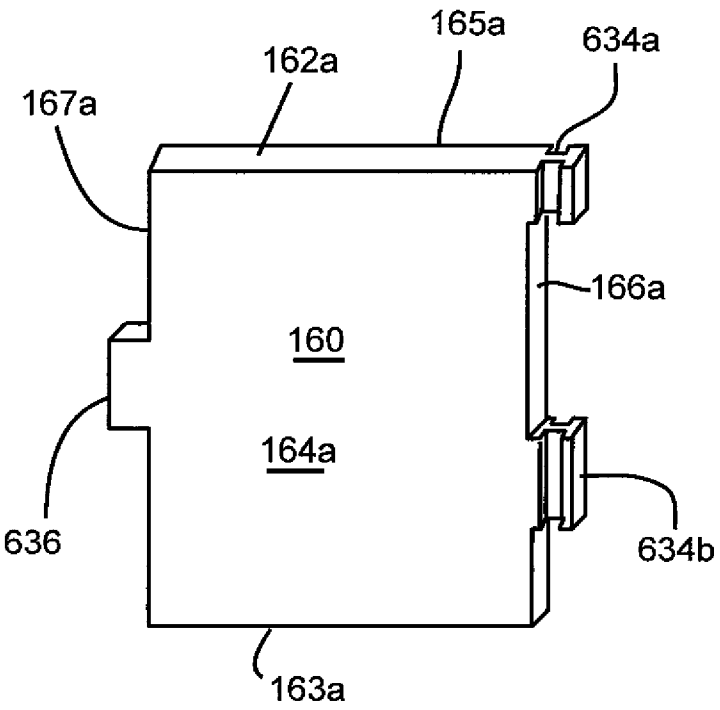
FIGS. 2 and 2*a* are images of risers and curve-about risers, respectively.
Figure 2:
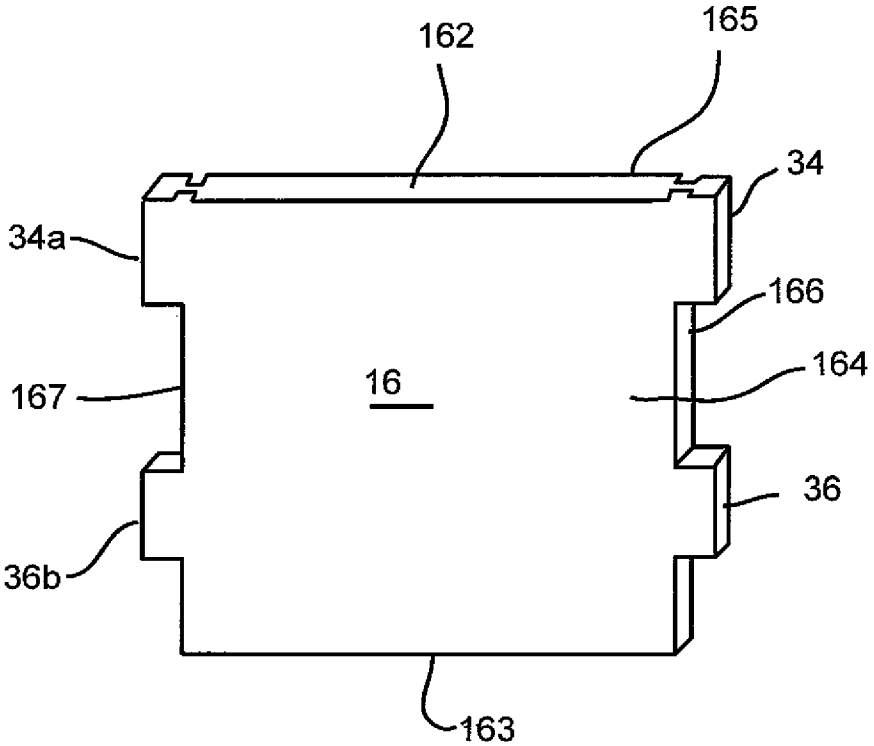
Figure 3:
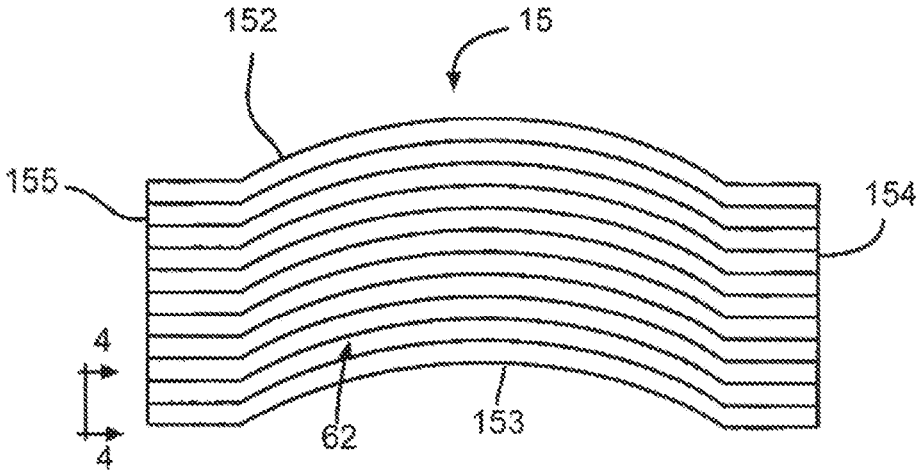
FIG. 3 is a top view of a ladder step—and also a curve-about step without the extensive curvature and the extension.
Figure 4:
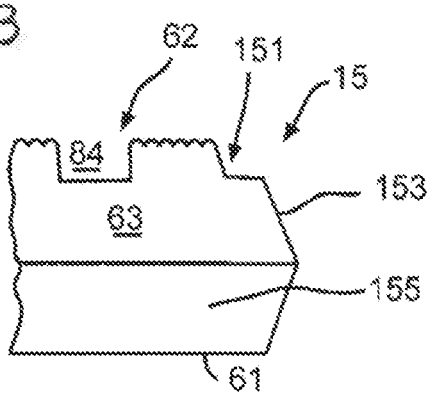
FIG. 4 is a view of FIG. 3 taken along the lines 4-4.
Figure 5:
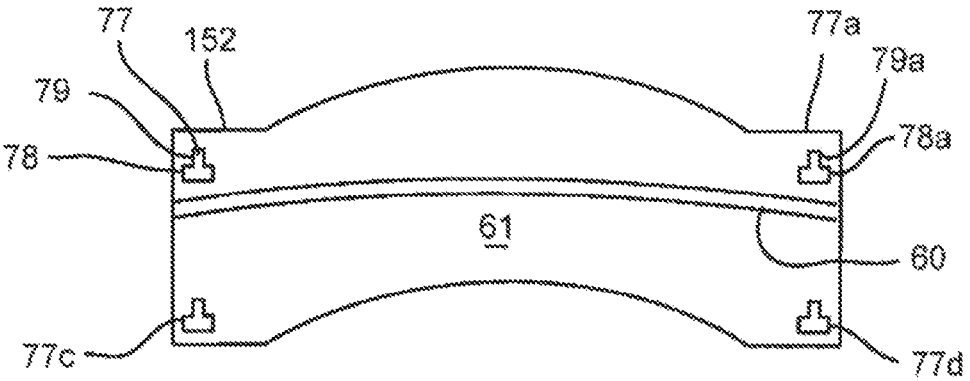
FIG. 5 is a bottom view of a ladder step—and also a curve about step without the extensive curvature and the extension.
Figure 6:
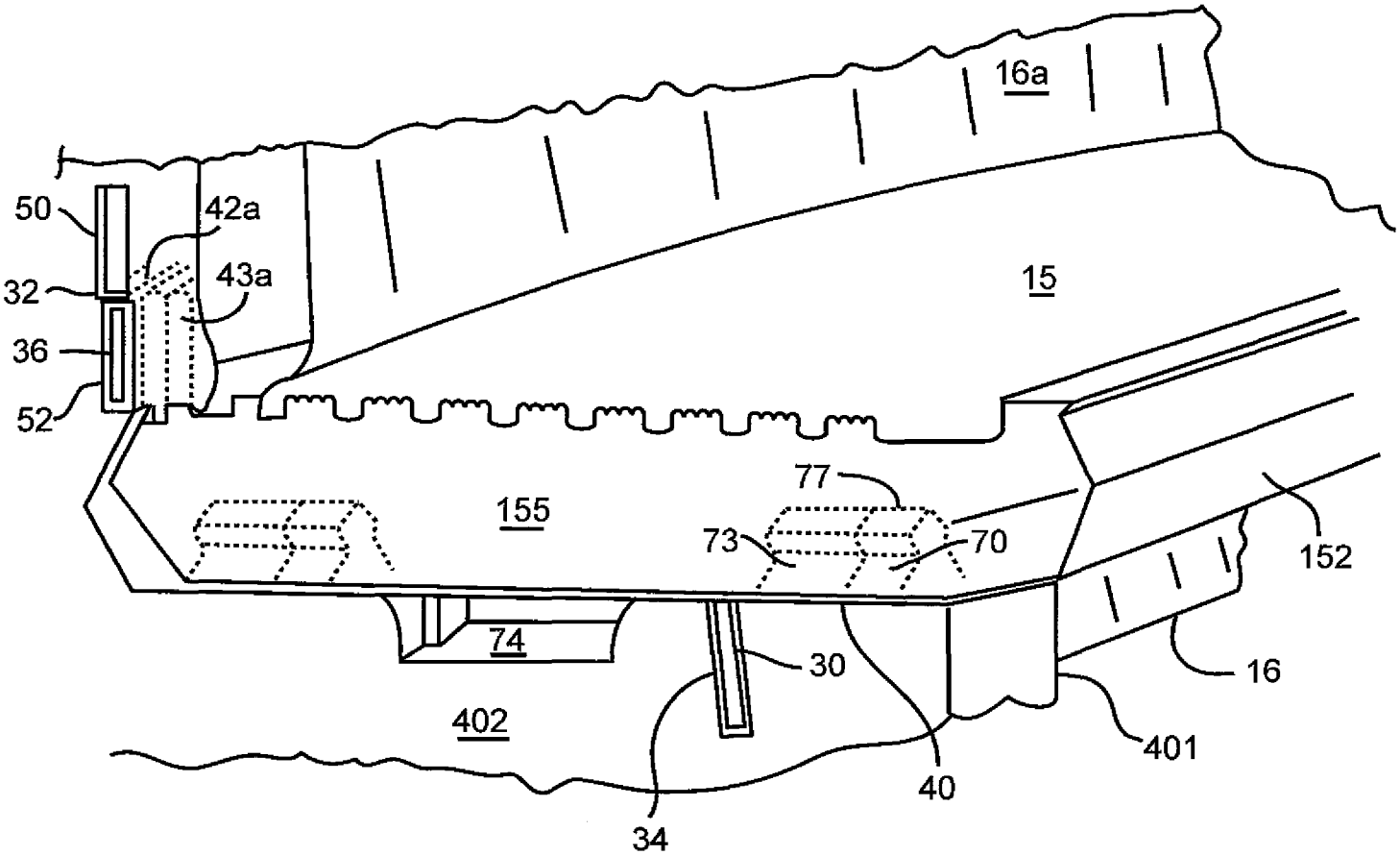
FIG. 6 is a view of FIG. 1 taken along the lines 6-6.
Figure 7:
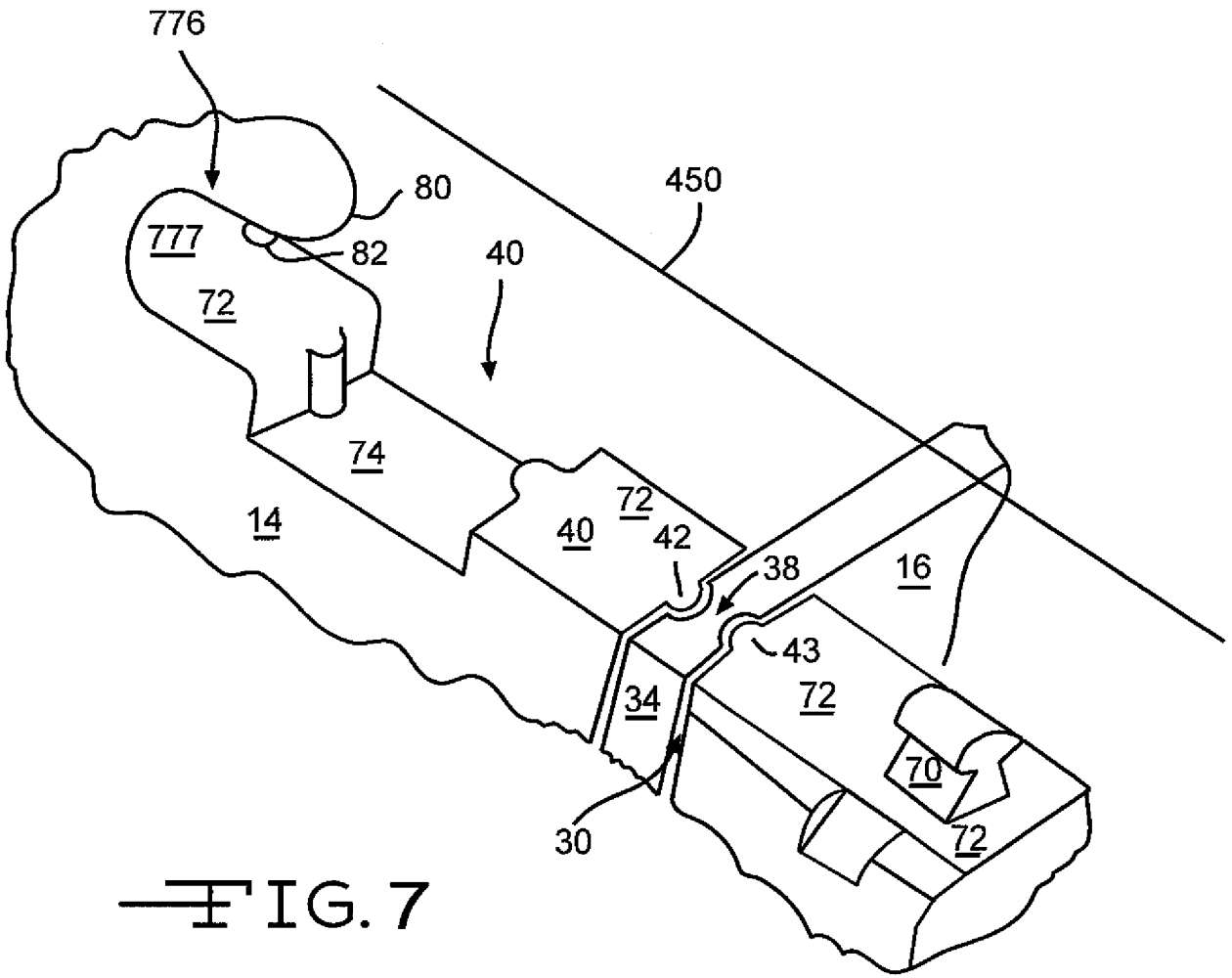
FIG. 7 is FIG. 6 without a step.
Figure 8:
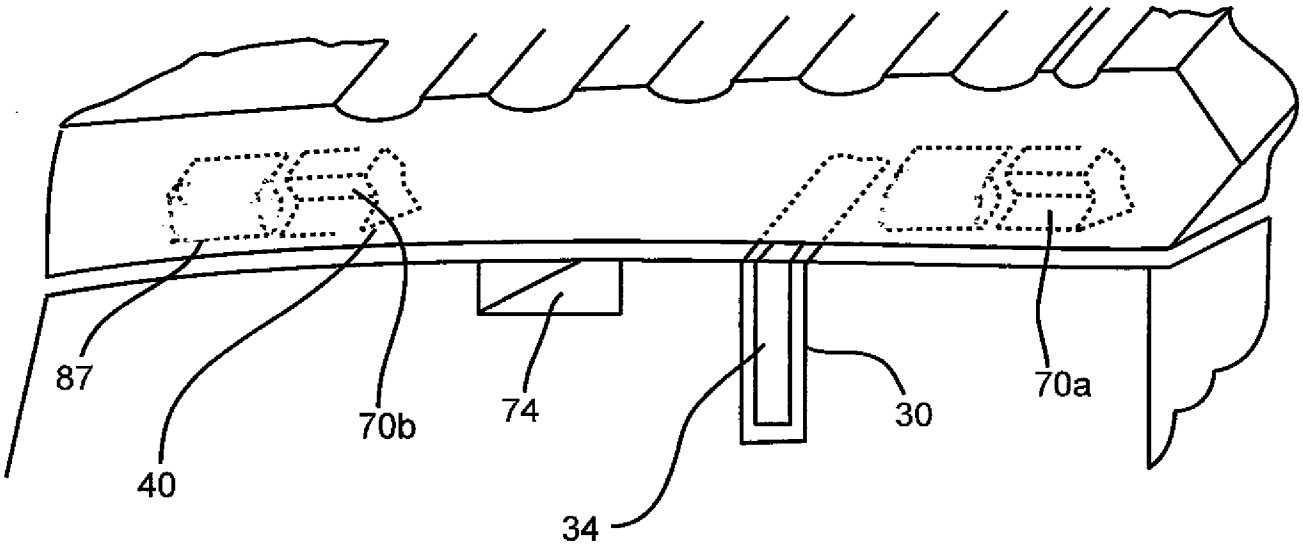
FIG. 8 is a view of FIG. 1 taken along the lines 8-8.
Figure 9:
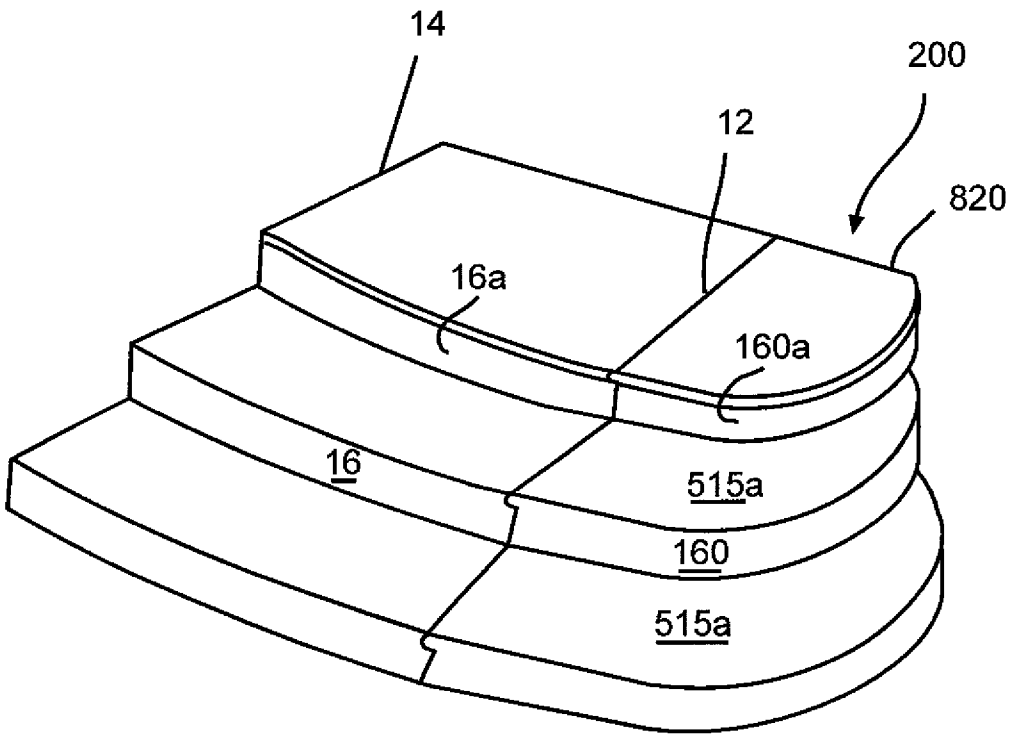
FIG. 9 is an alternative embodiment of FIG. 1.
Figure 10:
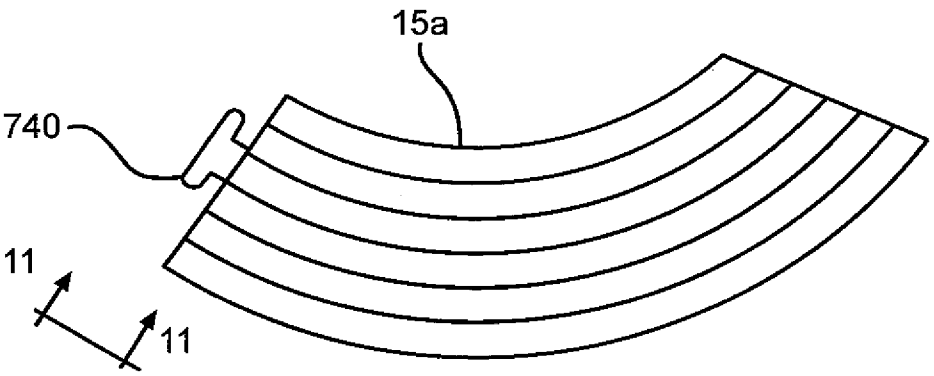
FIG. 10 is top view of a curve-about step.
Figure 11:
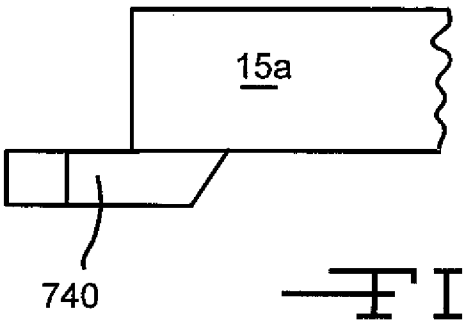
FIG. 11 is a side view of FIG. 10 taken along the lines a-a.
Figure 12:
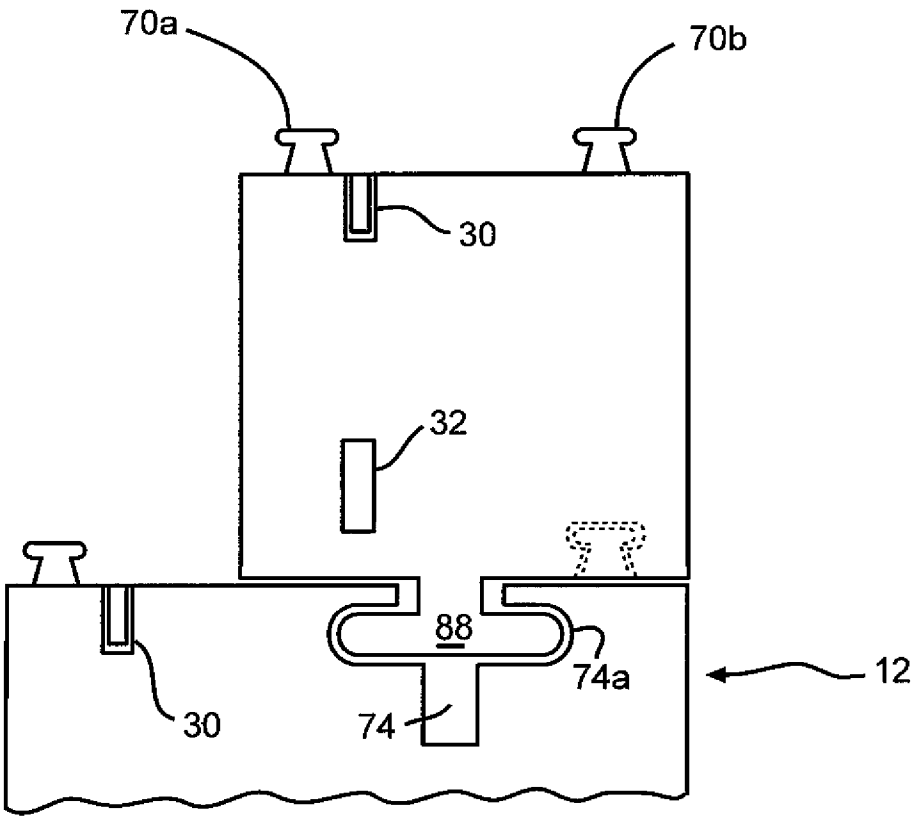
FIG. 12 is an alternative embodiment of FIG. 1 taken along the lines b-b.
Figure 13A:
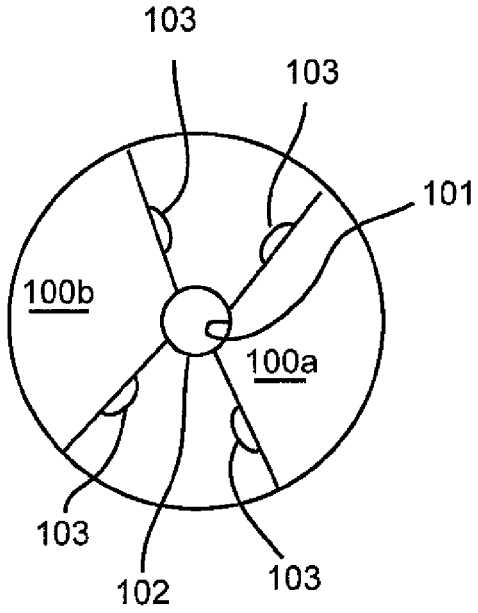
FIG. 13*a* and *b* are images of rail figures capable of being used in FIGS. 1 and 9.
Figure 13B:
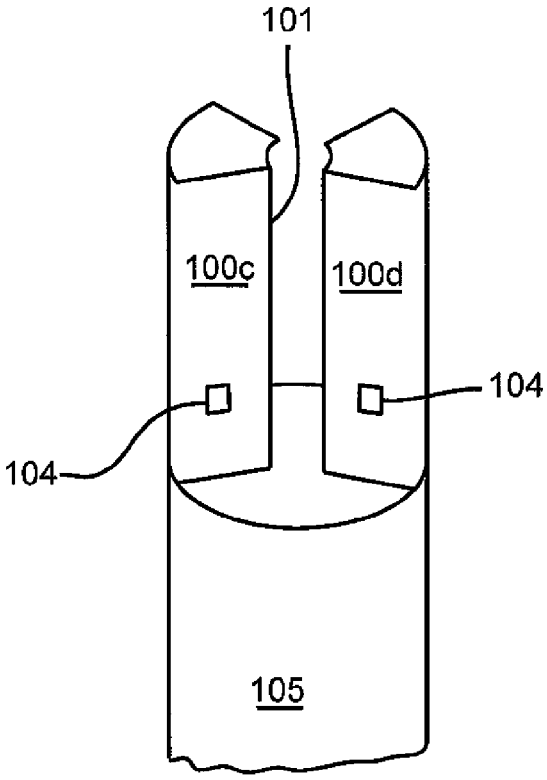

The current invention is a step ladder that can have either three steps 10, for an in-ground pool configuration, or four steps 20, for an above-ground pool configuration. The three-step step ladder has three steps 15 and three risers 16, a right support 12 and a left support 14.

The right support 12 and the left support 14 are essentially mirror images of each other. Each support 12, 14 has a high aperture 30 and a low aperture 32 to respectively receive the riser's upper hour-glass protrusion 34 and lower hour-glass protrusion 36. The high aperture 30 (a) extends downwardly from each support's step support 40 and (b) has a front male protrusion 43 and a back male protrusion 42 that contacts the narrow section 38 of the upper hour-glass protrusion. The lower aperture 32 is positioned below the high aperture 30 and has a broad entry area 50 and a front riser secure area 52. The broad entry area 50 receives the lower hour glass protrusion 36;

the front riser secure area 52 has a front male protrusion 43*a* and a back male protrusion 42*a* that contacts the narrow section 38*a* of the lower hour-glass protrusion. This double aperture configuration stabilizes the risers, compared to the prior art risers that used only one aperture configuration.

Each riser is positioned to be received in a riser groove 60 on the bottom surface 61 of a corresponding step 15 positioned above the specific riser. Each step has a top surface 62, and a side surface 63 that separates the top and bottom surfaces.

Each non-top step right support 40 has a standard male step protrusion 70 having a neck area wherein the proximal end of the neck area protrudes from an essentially planar support surface 72 and an enlarged head section protrudes from the distal end of the neck area, the essentially planar support surface 72, a curve-about receiver 74, and a back-overhang area 76. The step 15 has, on its bottom surface 61, a corresponding female receiver having a back section 78 that receives the male step protrusion and a front section 79 that securely attaches to male step protrusion when the step is pushed back to contact the back-overhang area's back wall 777. The overhang surface 80 of the back-overhang area 776 has a male protrusion 82 that fits into a wide, deep groove 84 positioned on the step's top surface 62 when the step contacts the back-overhang area's back wall 777.

The top step right support 401 on the three-step step ladder configuration is similar to the other non-top step right supports, except it has no back-overhand area 776 and has a fourth step/curve-about extension aperture 740. The fourth step extension aperture 74*a* receives a fourth step extension 88. The fourth step extension 88 has riser apertures that are identical to the upper and lower apertures 30, 32, and a step support surface 89 having a front standard step protrusion 70*a* and a back standard step protrusion 70*b* that corresponds to female apertures positioned on fourth step's bottom surface.

The left step support 40*a* is similar to the right support, except there may not be a curve-about receiver 74.

Each support also has two pairs of two front rail apertures and two pairs of two back rail apertures. The lower set of front and back rail apertures are designed for the three-step step ladder and the upper set of front and back rail apertures are designed for the four-step step ladder. Each rail aperture has a top section 90 that receives the corresponding rail male protrusion and lower section 91 that secures the corresponding rail male protrusion 92 having an hour-glass configuration as described above.

The rail protrusions are extensions from the proximal end of the vertical section of the rail. At the distal end of the vertical section is a jigsaw-attachment configuration. The jigsaw attachment configuration has two quarter pie-shaped extensions 100 *a, b*, opposing each other, and the extension's narrowest areas are separated by a center cavity 101 for a distance extending from the distal end to the proximal end for about half the length of the extension, and joined together 102 for the remainder of the extension. The extension area separated by the cavity has at least one protrusion 103. Likewise, the rail section 105 that essentially parallels the steps has a corresponding jigsaw attachment configuration 100*c*, 100*d* except it has an aperture 104 to receive the protrusion.

An interesting part of the risers 16 and steps 15 as used in this step ladder, is that the risers and steps can be altered between concave and convex configurations in the right and left supports 12, 14.

Optionally, the purchaser may want to add a curve about apparatus 200 to the right support 12. The curve about has a support 214 that is essentially identical to the left support except it has male back protrusions 215 that attaches to the right support 12 where the rails would attach if there was no curve-about section.

The curve-about risers 160, 160*a* are identical to the risers 16, 16*a* except the curve about-risers have a protrusion 636 positioned on the left side that securely fits into the broad entry area 50. Likewise, the curve-about steps 15*a* are identical to the corresponding ladder steps 15 except the left side has a protrusion that securely fits in the curve-about receiver 74.

The step ladder, three or four step configuration with or without the curve-about, can have platform supports 300. Each platform support has a first surface and second surface separated by a side surface. The first surface has a first groove 302*a* and the second surface has a groove 302*b*. The only difference between the grooves is that one extends further down into the platform than the other. That way the consumer can determine which groove to position the step ladder thereon and simultaneously determine how much water flow should flow under the ladder.

Obviously, the right and left support members can be reversed so that the left side can have the curve-about components; and both the right and left support members can have curve-about components extending therefrom. Moreover, the risers are flexible to allow the risers to be concave or convex.

The invention claimed is:

1. A ladder comprising:

a first flexible riser and a second flexible riser, each riser having a top riser surface, a bottom riser surface, a front riser surface, a rear riser surface, a first side riser surface having a first upper hour-glass protrusion and a first lower hour-glass protrusion and a second riser side surface having a second upper hour-glass protrusion and a second lower hour-glass protrusion;

a non-top step having an upper step surface has a first top riser groove to receive the second riser's bottom surface, a second top riser groove, a front step surface, a rear step surface, a first side step surface, a second side step surface, a bottom step surface having (a) a bottom riser groove (i) to receive the first riser's top surface and (ii) extends from near the first side step surface to near the second side step surface, and (b) a first two-part aperture positioned between the bottom riser groove and the first side step surface and a second two-part aperture positioned between the bottom riser groove and the second side step surface wherein each two-part aperture has a receiving area and a securing area wherein the securing area in relation to the receiving area is closer to the front step surface;

a right support and a left support; wherein each right support surface and left support has (A) an interior support surface that contacts the first and second risers, (B) an exterior support surface, (C) a bottom support surface, (D) a back support surface, (E) a front support surface, (F) a step support section having (i) a male step protrusion that is capable of entering into the receiving area and sliding into the securing area and (ii) a high aperture (a) positioned between the male step protrusion and a back overhang area, and (b) having at least one side male protrusion capable of contacting a narrow section of the respective upper hour-glass protrusion, (G) the back support overhang area having a downward protrusion that positions itself into the second top riser groove when the male step protrusion is positioned in the securing area, and (H) a low support aperture (i) positioned below and a distance from the high aperture, (ii) having (a) a broad entry area and (b) a riser secure area wherein the respective lower hour-glass protrusion is capable of entering into the broad entry area and sliding into the riser secure area when the upper hour-glass protrusion is positioned in the upper aperture, wherein elements (A) to (H) form a hollow cavity that can be filled with air or a liquid;

wherein at least one of the right support surface and left support surface is capable of receiving a curve-about apparatus on the exterior support surface, then the step support section also has a curve-about receiver positioned between the high aperture and the back overhang area;

wherein a longitudinal axis of both the right support surface and the left support surface extends from the back support surface to the front support surface.

2. The ladder of claim 1 wherein the curve-about apparatus has a curve-about first flexible riser and a curve-about second flexible riser wherein each curve-about flexible riser has a top curve-about riser surface, a bottom curve-about riser surface, a front curve-about riser surface, a rear curve-about riser surface, a first curve-about side riser surface having a first upper hour-glass protrusion and a first lower hour-glass protrusion and a second curve-about riser side surface having a middle protrusion having a second hour-glass shape with a second narrow section wherein the second narrow section is capable of being securely positioned in the broad entry area when the curve-about apparatus connects to the ladder;

a curve-about non-top step having an upper curve-about step surface has a first top curve-about riser groove to receive the curve-about second riser's bottom surface, a second top curve-about riser groove, a front curve-about step surface, a rear curve-about step surface, a first curve-about side step surface, a second curve-about side step surface, a bottom curve-about step surface having (a) a bottom curve-about riser groove (i) to receive the first curve-about riser's top surface and (ii) extends from near the first curve-about side step surface to near the second curve-about side step surface, and (b) a first curve-about two-part aperture (i) positioned between the curve-about riser groove and the first curve-about side step surface and (ii) having a curve-about receiving area and a curve-about securing area wherein the curve-about securing area in relation to the curve-about receiving area is closer to the front curve-about step surface, and an insertion slot positioned below the bottom curve-about step surface and capable of being inserted into the curve-about receiver when the middle protrusion is positioned in the broad entry area;

a curve-about support surface having (A) an interior curve-about support surface that contacts the first curve-about riser, (B) an exterior curve-about support surface, (C) a bottom curve-about support surface, (D) a back curve-about support surface, (E) a front curve-about support surface, (F) a curve-about step support section having (i) a curve-about male step protrusion that is capable of entering into the curve-about receiving area and sliding into the curve-about securing area and (ii) a curve-about high aperture (a) positioned between the curve-about male step protrusion and a curve-about back overhang area, and (b) having at least one side curve-about male protrusion capable of contacting a curve-about narrow section of the curve-about upper hour-glass protrusion, (G) the curve-about back support overhang area having a curve-about downward protrusion that positions itself into the second curve-about top riser groove when the curve-about male step protrusion is positioned in the curve-about securing area, and (H) a curve-about low support aperture (i) positioned below and a distance from the curve-about high aperture, (ii) having (a) a curve-about broad entry area and (b) a curve-about riser secure area wherein the respective lower hour-glass protrusion is capable of entering into the broad entry area and sliding into the curve-about riser secure area when the curve-about upper hour-glass protrusion is positioned in the curve-about upper aperture, wherein elements (A) to (H) form a second hollow cavity that can be filled with air or a liquid;

wherein the curve-about support surface is at least transverse to the longitudinal axis.

* * * * *